US006848586B1

(12) United States Patent
Guliner

(10) Patent No.: US 6,848,586 B1
(45) Date of Patent: Feb. 1, 2005

(54) DIRECTOR CHAIR STORAGE RACK

(76) Inventor: Keith Guliner, 139 Charles St., New York, NY (US) 10014

( * ) Notice: Subject to any disclaimer, the term of this patent is extended or adjusted under 35 U.S.C. 154(b) by 0 days.

(21) Appl. No.: 10/431,050

(22) Filed: May 6, 2003

(51) Int. Cl.[7] ..... A47F 7/00
(52) U.S. Cl. ..... 211/49.1; 297/239
(58) Field of Search ..... 211/49.1; 297/239

(56) References Cited

U.S. PATENT DOCUMENTS

| | | | | |
|---|---|---|---|---|
| 2,916,152 A | | 3/1959 | Dull | |
| 3,021,010 A | | 2/1962 | McMasters | |
| 3,021,011 A | | 2/1962 | Visneski | |
| 3,102,733 A | * | 9/1963 | Burnett | 280/654 |
| 3,197,031 A | | 7/1965 | Loetz | |
| 3,273,823 A | | 9/1966 | Taylor, Jr. | |
| 3,661,268 A | | 5/1972 | Boley | |
| 4,257,523 A | | 3/1981 | Blasio | |
| 5,348,149 A | * | 9/1994 | McCarthy | 206/326 |
| 6,230,904 B1 | | 5/2001 | Licari | |

* cited by examiner

*Primary Examiner*—Robert W. Gibson, Jr.
(74) *Attorney, Agent, or Firm*—Schweitzer Cornman Gross & Bondell LLP

(57) ABSTRACT

A rack for collapsible director chairs has a base upon which collapsed chairs may be stacked and a support extending upwardly from the base to maintain the chairs in the stacked orientation. The support is dimensioned to be received by an open area of the collapsed chairs between the chair seat and transverse leg braces.

3 Claims, 2 Drawing Sheets

FIG. 3
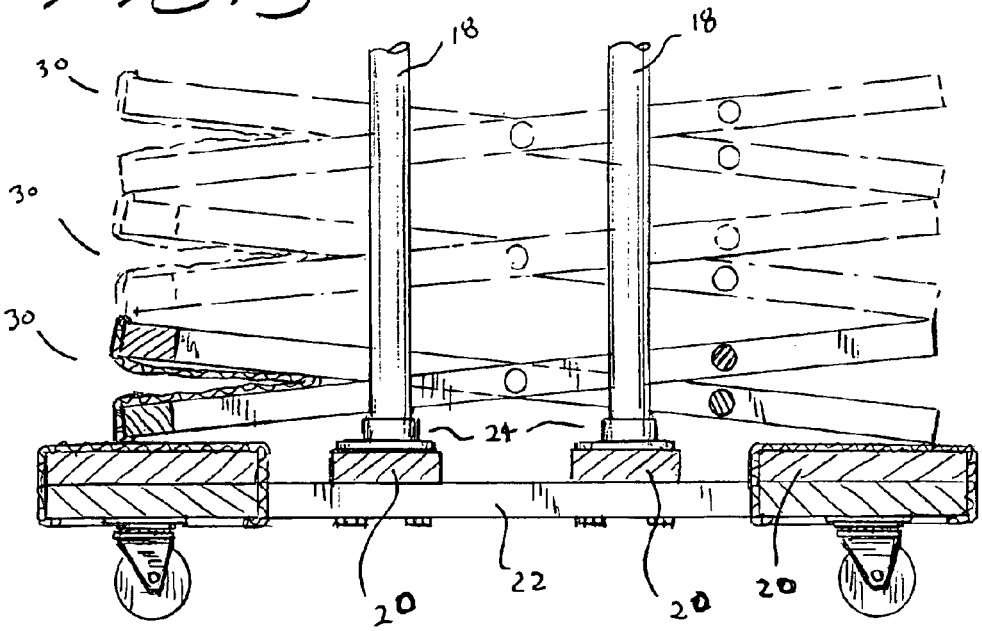
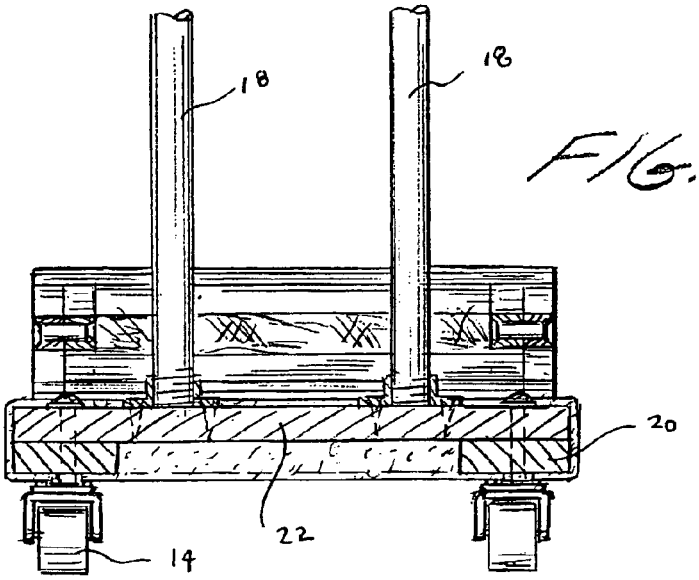
FIG. 4

DIRECTOR CHAIR STORAGE RACK

The present invention relates to a new and improved storage apparatus for director chairs.

BACKGROUND OF THE INVENTION

Director style chairs, which have two pairs of legs pivotly joined together and a seat, typically of a flexible, textile material such as canvas slung between bars attached to the leg pairs, are a popular form of seating, and are often employed when large numbers of temporary seating are needed, such as in connection with a "on location" motion picture production. Because the chairs easily collapse to a compact size and are relatively light weight, they are an efficient means for providing such seating.

It has heretofore been difficult, however, to efficiently and economically store and transport large quantities of the chairs. Transport has typically been performed by piling the collapsed chairs in a random manner in a large wheeled hamper, and transporting the hamper as desired. The side walls of the hamper hinder loading and unloading, and the lack of means associated with the hamper for arranging or orienting the chairs for stacking therein, limits efficiency. Alternatively, the chairs are simply stored and carried individually.

It is according a purpose of the present invention to provide a rack for director chairs which is of economical and simple construction, and which provides for efficient loading, storage, and unloading of the chairs thereon.

BRIEF DESCRIPTIONS OF THE INVENTION

In accordance with the foregoing and other objects and purposes, a director chair storage rack in accordance with the present invention comprises a mobile base providing a platform on which the chairs are loaded. A vertically-extending post system extends upwardly from the platform and is dimensioned in plan to allow an interior opening of a collapsed director chair to be accepted thereby. The guide rails allow a plurality of collapsed chairs to be placed one on top of another in a vertical array, providing a compact and efficient rack mechanism.

BRIEF DESCRIPTION OF THE DRAWINGS

A fuller understanding of the present invention will be obtained upon consideration of the following, detailed description of a preferred, but nonetheless illustrative embodiment of the invention, when reviewed in connection with the annexed Figures, wherein:

FIG. 3 is a section view taken along line 3—3 of FIG. 1; and

FIG. 4 is a section view taken along line 4—4 of FIG. 1.

DETAILED DESCRIPTION OF THE INVENTION

Figure 1:
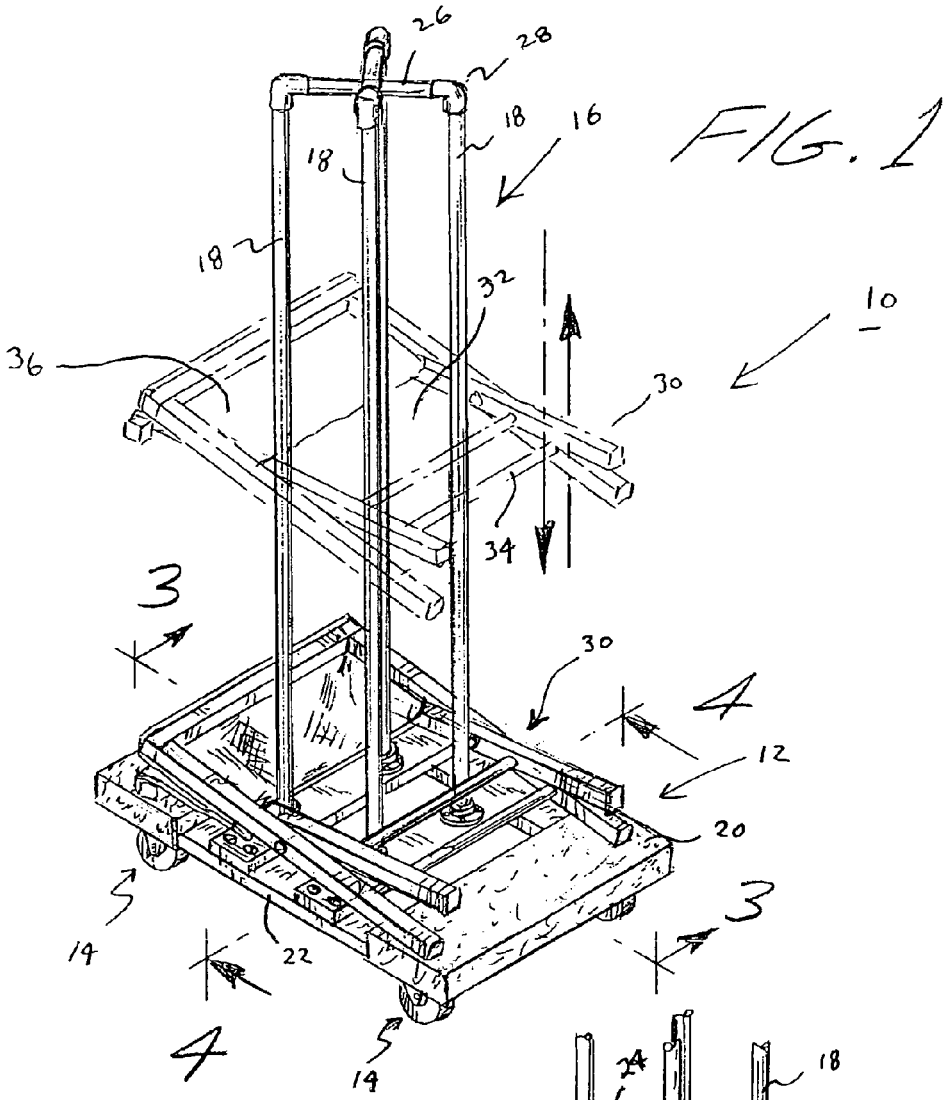
FIG. 1 is a perspective view of the invention with a chair thereon, and depicting in phantom a second collapsed in a state of placement/removal therefrom.
Figure 2:
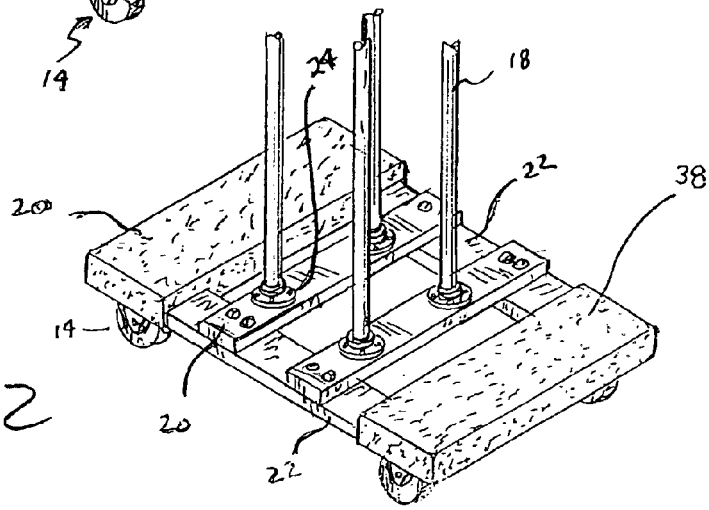
FIG. 2 is a perspective view of a lower portion of the invention.

With reference to the Figures, a director chair rack 10 in accordance with the present invention includes base 12 having a set of casters 14 to allow the rack to be moved as desired. Extending vertically upward from the central portion of the base is chair support means 16, which may comprise four spaced tubular elements 18. The base 12 may be of a dolly-like construction, having a plurality of laterally-extending slats 20 joined by longitudinal rails 22 to which the casters 14 are fastened. Each of the tubular elements 18 is fastened to one of an interior slat 20 by an appropriate transition piece or socket 24 which is in turn screwed or bolted to the slats. Tubular elements 18 may be preferably formed of galvanized pipe with threaded ends, the threaded ends being mateably joined with a complimentary threaded bore in the sockets 24, which may be in the form of pipe fittings.

As shown, the tubular elements 18 may preferably be arranged in a rectangular configuration in plan or footprint. The elements defining opposite corners of the so-described rectangle are joined at their top ends by diagonal crossing pipe elements 26 mounted to the top ends of the tubular elements 18 by elbows 28. As may be seen in FIG. 1, when folded, a director chair 30 has an open area 32 between the pairs leg braces 34 joining the legs and the collapsed seat portion 36. The rectangular footprint orientation of the tubular elements 18 is such that it allows the chair support means 16 to be accepted within the open area 32, whereby a first collapsed chair 30 may be placed flat on the base 12, and in particular, upon at least the distal lateral slats 20, with the chair support means 16 extending upwardly through the open area 32 to maintain the chair on the base. Additional chairs may be likewise stacked on the rack, an array of the stacked chairs extending upwardly, as shown in FIG. 3, the chair support means 16 projecting upwardly through the generally aligned open areas 32 of the chairs to maintain the chairs in register with each other and prevent the stacked chairs from toppling. The rack, either with or without chairs stacked thereon, may be easily rolled from place to place as desired on the casters 14, the chair support means 16 maintaining the chairs in the vertical, stacked orientation. The chairs can be easily lifted up and removed from the rack as desired.

In addition to the chair support means 16 being manufactured of generally available pipe, the base 12 may be constructed of any appropriate material, such as wood. The distal lateral slats 20 may be provided with a resilient material 38, such as a carpet-like surface, to provide a non-slip, non-scratching base surface for the chair placed directly thereon.

I claim:

1. A method for storing a director chair, comprising the steps of collapsing the director chair and placing the collapsed chair oriented in a generally horizontal position upon a base of a chair rack and about chair support means extending vertically upward from the base, wherebv the placing step includes the step of orienting the chair to be supported on the base by a pair of distal lateral base slats having top surfaces extending above top surfaces of interior lateral base slats, the chair support means having a footprint of a size such that the chair support means is received by an open enclosed area of the collapsed director chair between a seat and transverse leg braces of the chair.

2. The method of claim 1 further comprising the step of repositioning the collapsed chair by rolling the chair rack with the chair thereon to a desired position by the use of casters affixed to the base.

3. A method for storing a plurality of director chairs in a vertical array, comprising the steps of collapsing each director chair, placing a first one of the director chairs in a generally horizontal position upon a base of a chair rack and about chair support means extending vertically upward from the base, the chair support means having a footprint of a size such that the chair support means is received by an open enclosed area of the first collapsed director chair between a seat and transverse leg braces of the chair, and then placing each of the remaining director chairs to be stored a generally horizontal position upon a topmost director chair on the rack about the chair support means such that the chair support means is received by an open enclosed area of the placed collapsed director chair between a seat and transverse leg braces of the chair and a vertically-extending supported array of collapsed chairs is created, the step of placing the first director chair upon the base including the step of orienting the chair such that the chair is supported on the base by a pair of distal lateral base slats having top surfaces extending above top surface of interior lateral base slats.

* * * * *